United States Patent [19]

Salsgiver et al.

[11] Patent Number: 4,915,750

[45] Date of Patent: Apr. 10, 1990

[54] METHOD FOR PROVIDING HEAT RESISTANT DOMAIN REFINEMENT OF ELECTRICAL STEELS TO REDUCE CORE LOSS

[75] Inventors: James A. Salsgiver, Sarver; Randal K. Knipe, Natrona Heights, both of Pa.

[73] Assignee: Allegheny Ludlum Corporation, Pittsburgh, Pa.

[21] Appl. No.: 163,670

[22] Filed: Mar. 3, 1988

[51] Int. Cl.[4] ..... H01F 1/04

[52] U.S. Cl. ..... 148/112; 148/121; 219/121.12; 219/121.35

[58] Field of Search ..... 148/111, 112, 113, 120, 148/121, 122; 219/121.12, 121.35

[56] References Cited

U.S. PATENT DOCUMENTS

| | | | |
|---|---|---|---|
| 3,999,923 | 11/1976 | Takashina et al. | 148/111 |
| 4,554,029 | 11/1985 | Schoen et al. | 148/112 |
| 4,652,316 | 3/1987 | Beckley | 148/111 |
| 4,655,854 | 4/1987 | Nishiike et al. | 148/111 |
| 4,750,949 | 6/1988 | Kobayashi et al. | 148/111 |

FOREIGN PATENT DOCUMENTS

| | | | |
|---|---|---|---|
| 0875587 | 9/1983 | European Pat. Off. | 148/121 |
| 60-213005 | 10/1985 | Japan | 148/121 |

*Primary Examiner*—John P. Sheehan

*Attorney, Agent, or Firm*—Patrick J. Viccaro

[57] ABSTRACT

A method is provided for heat resistant domain refinement of texture annealed and insulation coated grain-oriented silicon steel strip and amorphous magnetic materials by subjecting at least one surface of the steel to an electron beam treatment to produce permanent defects to effect domain refinement with narrow substantially parallel bands of treated regions separated by untreated regions substantially transverse to the direction of strip manufacture.

19 Claims, 2 Drawing Sheets

MELT ZONE

INTERFACE

BASEMETAL

TREATED

UNTREATED

METHOD FOR PROVIDING HEAT RESISTANT DOMAIN REFINEMENT OF ELECTRICAL STEELS TO REDUCE CORE LOSS

BACKGROUND OF THE INVENTION

This invention relates to a method for working the surface of electrical sheet or strip products to affect the domain size so as to reduce the core loss properties. More particularly, this invention relates to providing localized strains in the surface of electrical steels by electron beam treatment to provide heat resistant domain refinement.

In the manufacture of grain oriented silicon steel, it is known that the Goss secondary recrystallization texture, (110) [001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge, typically 7 or 9 mils, and up to 14 mils, with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

Grain-oriented silicon steel is conventionally used in electrical applications, such as power transformers, distribution transformers, generators, and the like. The domain structure and resistivity of the steel in electrical applications permits cyclic variation of the applied magnetic field with limited energy loss, which is termed "core loss". It is desirable, therefore, in steels used for such applications, that such steels have reduced core loss values.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain oriented silicon steel and second, high permeability grain oriented silicon steel. Regular grain oriented silicon steel is generally characterized by permeabilities of less than 1850 at 10 Oersteds with a core loss of greater than 0.400 watts per pound (WPP) at 1.5 Tesla at 60 Hertz for nominally 9 mil material. High permeability grain oriented silicon steels are characterized by higher permeabilities and lower core losses. Such higher permeability steels may be the result of compositional changes alone or together with process changes. For example, high permeability silicon steels may contain nitrides, sulfides and/or borides which contribute to the precipitates and inclusions of the inhibition system which contribute to the properties of the final steel product. Furthermore, such high permeability silicon steels generally undergo cold reduction operations to final gauge wherein a final heavy cold reduction on the order of greater than 80% is made in order to facilitate the grain orientation.

It is known that domain size and thereby core loss values of electrical steels, such as amorphous materials and particularly grain-oriented silicon steels, may be reduced if the steel is subjected to any of various practices to induce localized strains in the surface of the steel. Such practices may be generally referred to as "scribing" or "domain refining" and are performed after the final high temperature annealing operation. If the steel is scribed after the final texture annealing, then there is induced a localized stress state in the texture annealed sheet so that the domain wall spacing is reduced. These disturbances typically are relatively narrow, straight lines, or scribes generally spaced at regular intervals. The scribe lines are substantially transverse to the rolling direction and typically are applied to only one side of the steel.

In the use of such amorphous and grain-oriented silicon steels, the particular end use and the fabrication techniques may require that the scribed steel product survive a stress relief anneal (SRA), while other products do not undergo such an SRA. During fabrication incident to the production of stacked core transformers and, more particularly, in the power transformers of the United States, there is a demand for a flat, domain refined silicon steel which is not subjected to stress relief annealing. In other words, the scribed steel does not have to provide heat resistant domain refinement.

During the fabrication incident to the production of other transformers, such as most distribution transformers in the United States, the steel is cut and subjected to various bending and shaping operations which produce stresses in the steel. In such instances, it is necessary and conventional for manufacturers to stress relief anneal the product to relieve such stresses. During stress relief annealing, it has been found that the beneficial effect on core loss resulting from some scribing techniques, such as thermal scribing, are lost. For such end uses, it is required and desired that the product exhibit heat resistant domain refinement (HRDR) in order to retain the improvements in core loss values resulting from scribing.

It has also been suggested in prior patent art that electron beam technology may be suitable for scribing silicon steel. U.S. Pat. No. 3,990,923-Takashina et al., dated Nov. 9, 1976 discloses that electron beams may be used on primary recrystallized silicon steel to control or inhibit the growth of secondary recrystallization grains. U.S. Pat. No. 4,554,029-Schoen et al., dated Nov. 19, 1985, generally discloses that electron beam resistance heating may be used on finally annealed electrical steel if damage of the insulated coating is not of concern. The damage to the insulative coating and requirements of a vacuum were considered to be major drawbacks. There is no teaching or suggestion in the art, however, of any actual or practical use of electron beam technology for scribing electrical steels.

A copending application, Ser. No. 163,448, filed Mar. 3, 1988, by the assignee of this invention discloses a method and apparatus of electron beam treatment to affect domain size and improve core loss without damaging any coating thereon or changing the shape thereof.

What is needed is a method and apparatus for treating electrical sheet products to effect domain refinement which is heat resistant and can withstand a stress relief anneal (SRA) typically used in the fabrication of transformers. Still further, the method and apparatus should be suitable for treating grain-oriented silicon steels of both the high permeability and conventional types as well as amorphous type electrical materials.

SUMMARY OF THE INVENTION

In accordance with the present invention, there is provided a method for improving the core loss of electrical sheet or strip having final annealed magnetic domain structures, the method which includes subjecting at least one surface of the sheet to an electron beam treatment to produce narrow substantially parallel bands of treated regions separated by untreated regions substantially transverse to the direction of sheet manufacture. The electron beam treatment includes providing an energy density sufficient to produce a permanent defect in each treated region to effect a refinement of magnetic domain wall spacing which is heat resistant. The treated sheet is subsequently processed by annealing, applying a tension coating, or some combination to reduce the core loss.

DETAILED DESCRIPTION OF THE PREFERRED EMBODIMENTS

Figure 1:
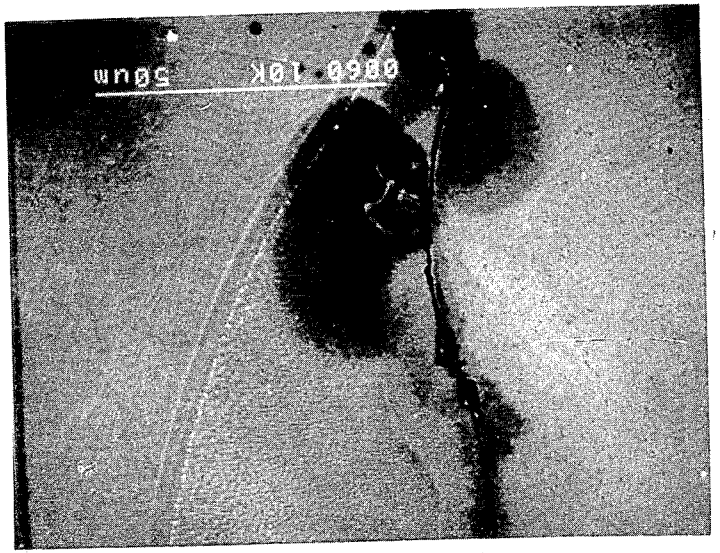
FIG. 1 is a photomicrograph in partial cross-section of Steel 2 of Example I showing a typical treated region.

Broadly, in accordance with the present invention, a method is provided for improving the magnetic properties of regular and high permeability grain-oriented silicon steels and amorphous materials. Preferably, the method is useful for treating such steels to effect a permanent refinement of the magnetic domain wall spacing for improving core loss of the steel strip. The width of the scribed lines and the spacing of the treated regions or lines substantially transverse to the rolling direction of the silicon strip and the casting direction of amorphous material is conventional. What is not conventional, however, is the method of the present invention for effecting such magnetic domain wall spacing in a controlled manner such that the steel so treated has improved magnetic properties which are heat resistant to survive a stress relief anneal (SRA).

Typical electron beam generating equipment used in welding and cutting, for example, requires that the electron beam be generated in and used in at least a partial vacuum in order to provide control of the beam and spot size or width focused on the workpiece. Such typical equipment was modified and used in the development of the present invention. A particular modification included high frequency electron beam deflection coils to generate selected patterns to scan the electrical sheet. The speed at which the electron beam traversed the steel sheet was controlled in the laboratory development work by setting the scan frequency with a waveform generator (sold by Wavetek) which drove the electron beam deflection coils.

As used herein, the electron beam useful in the present invention could have a direct current (DC) for providing continuous beam energy or a modulated current for providing pulsed or discontinuous beam energy. Unless otherwise specified herein, the DC electron beam was used in the examples. Furthermore, although a single electron beam was used, a plurality of beams may be used to create a single treated region or to create a plurality of regions at the same time.

Other parameters or conditions of the electron beam must also be selected within certain ranges in order to provide the proper balance to effect the domain refinement. The current of the electron beam may range from 0.5 to 100 milliamperes (ma); however, narrower preferred ranges may be selected for specific equipment and conditions as described herein. The voltage of the electron beam generated may range from 20 to 200 kilovolts (kv), preferably 60 to 150 kv. For these ranges of currents and voltages, the speed at which the electron beam traverses the steel strip must be properly selected in order to effect the domain refinement and create a permanent defect which will improve core loss values which survive subsequent annealing. It has been found that the scanning speed may range up to 10,000 ips. It should be understood that the parameters of current, voltage, scan speed, and strip speed are interdependent for a desired scribing effect; selected and preferred ranges of the parameters are dependent upon machine design and production requirements. For example, the electron beam current is adjusted to compensate for the speed of the strip and the electron beam scan speed. As a practical matter, based on the speed of the strip, the scan speed for a given width of strip would be determined and from that the desired and suitable electrical parameters would be set to satisfactorily treat the strip in accordance with the present invention.

The size of the electron beam focused on and imparting energy to the strip is also an important factor in determining the effect of domain refinement. Conventional electron beam generating equipment can produce electron beam diameters on the order of 4 to 16 mils in a hard vacuum, usually less than $10^{-4}$ Torr. The electron beam generally produced focuses an elliptical or circular spot size. It is expected that other shapes may be suitable. The focussed beam spot size effectively determines the width of the narrow irradiated or treated regions. The size across the focussed spot, in terms of diameter or width, of the electron beam used in the laboratory development work herein was on the order of 5 mils, unless otherwise specified.

A key parameter for the electron beam treatment in accordance with the present invention is the energy being transferred to the electrical material. Particularly, it was found that it is not the beam power, but the energy density which is determinative of the extent of treatment to the sheet material. The energy density is a function of the electron current, voltage, scanning speed, spot size, and the number of beams used on the treated region. The energy density may be defined as the energy per area in units of Joules per square inch ($J/in^2$). The areal energy density should be about 150

J/in$^2$ or more and may range from 150 to 4000 J/in$^2$ (230 to 620 J/cm$^2$). In developing the present invention, the electron beam spot size of 5 mils was constant. The linear energy density can be simply calculated by dividing the beam power (in J/sec. units) by the beam scanning speed (in ips units). With low beam currents of 0.5 to 10 ma, the linear energy density, expressed in such units should be about 0.75 J/in. or more and may range from 0.75 to 20 J/in. (0.3 to 7.9 J/cm). Broadly, the upper limit of energy density is that value at which the sheet is severely damaged or cut through.

The specific parameters within the ranges identified depend upon the type and end use of the domain refined electrical steel. When the end use is in distribution or wound core transformers, for example, where heat resistant domain refining is needed, then the parameters will need to be selected so that the controlled working and damage to the steel will survive a subsequent stress relief anneal which is used to relieve the mechanical stresses induced in making fabricated steel articles. The electron beam treatment for the present invention will vary somewhat between grain-oriented silicon steels of the regular or conventional type and a high permeability steel as well as with amorphous metals. Any of these magnetic materials may have an insulative coating thereon, such as a mill glass, applied coating, or combination thereof. Another factor to consider in establishing the parameters for electron beam treatment is whether or not the coating on the final annealed electrical steel is damaged as a result of the treatment. Generally, it would be advantageous and desirable that the coating would not be damaged or removed in the areas of the induced stress so as to avoid any subsequent recoating process. An acceptable trade-off, however, to subsequent recoating steps is an electron beam treatment which provides a permanent and heat resistant domain refinement.

Although the present invention described in detail hereafter has utility with grain-oriented silicon steel generally, the following typical compositions are two examples of silicon steel compositions adapted for use with the present invention and which were used in developing the present invention. The steel melts of the two steels initially contained the nominal compositions of:

| Steel | C | N | Mn | S | Si | Cu | B | Fe |
|---|---|---|---|---|---|---|---|---|
| 1 | .030 | 50 PPM | .07 | .022 | 3.15 | .22 | — | Bal. |
| 2 | .030 | Less than 50 PPM | .038 | .017 | 3.15 | .30 | 10 PPM | Bal. |

Unless otherwise noted, all composition ranges are in weight percent.

Steel 1 is a conventional grain-oriented silicon steel and Steel 2 is a high permeability grain-oriented silicon steel. Both Steels 1 and 2 were produced by casting, hot rolling, normalizing, cold rolling to final gauge with an intermediate annealing when two or more cold rolling stages were used, decarburizing, coating with MgO and final texture annealing to achieve the desired secondary recrystallization of cube-on-edge orientation. After decarburizing the steel, a refractory oxide base coating containing primarily magnesium oxide was applied before final texture annealing at elevated temperature, such annealing caused a reaction at the steel surface to create a forsterite base coating. Although the steel melts of Steels 1 and 2 initially contained the nominal compositions recited above, after final texture annealing, the C, N and S were reduced to trace levels of less than about 0.001% by weight.

In order to better understand the present invention, the following examples are presented.

EXAMPLE I

To illustrate the several aspects of the domain refining process of the present invention, various samples of the silicon steel having a composition similar to Steel 2 were melted, cast, hot rolled, cold rolled to a final gauge of about 9-mils, intermediate annealed when necessary, decarburized, and final texture annealed with an MgO annealing separator coating. The final texture annealed and base coated sample was magnetically tested before electron beam treatment to be used as a Control Pack. One surface of the steel was subjected to an electron beam treatment to produce narrow substantially parallel bands of treated regions separated by untreated regions substantially transverse to the rolling direction. For Epstein Pack 40-33*a*, the strips were about 1.2 inches wide and were passed under a stationary or fixed electron beam at 3.3 ips and subsequently stress relief annealed, tension coated, and again stress relief annealed as indicated.

The electron beam was generated by a machine manufactured by Leybold Heraeus. The machine generated a beam having a spot size of about 5 mils for treating the steels in a vacuum of about $10^{-4}$ Torr or better. The parallel bands of treated regions were about 6 millimeters apart.

The magnetic properties of core loss at 60 Hertz (Hz) at 1.3, 1.5 and 1.7 Tesla, permeability at 10 Oersteds (H) and at an induction of 200 Gauss were determined in a conventional manner for Epstein Packs. Samples were also stress relief annealed each time at 1475° F. (800° C.) temperature for 2 hours in a protective atmosphere.

TABLE I

| Pack No/ | Electron Beam Parameters | | | | Core Loss @ 60 Hz mWPP | | | % Improvements in Core Loss | | | Permeability | |
|---|---|---|---|---|---|---|---|---|---|---|---|---|
| Condition | Current ma | Voltage kV | Speed ips | Linear Energy Density (J/in) | 1.3 T | 1.5 T | 1.7 T | 1.3 T | 1.5% | 1.7 T | @ 10H | @ 200B |
| 40-33A (Control) | — | — | — | — | 324 | 435 | 613 | — | — | — | 1896 | 11,600 |
| Treated | 1 | 60 | 3.3 | 17.5 | 616 | 767 | 966 | NI | NI | NI | 814 | 286 |
| SRA | — | — | — | — | 317 | 430 | 598 | 2.2 | 1.1 | 2.4 | 1897 | 7,410 |
| T-Coated | — | — | — | — | 314 | 425 | 594 | 3.1 | 2.3 | 3.1 | 1891 | 9,620 |
| 2nd SRA | — | — | — | — | 309 | 417 | 582 | 4.6 | 4.1 | 5.1 | 1893 | 9,390 |
| 3rd SRA | — | — | — | — | 310 | 419 | 586 | 4.3 | 3.7 | 4.4 | 1895 | 9,480 |

T-Coated - Tension Coated
NI - No improvement

Under the experimental conditions described above for the electron beam, linear energy density, current, voltage and traversing speed, Table I shows the effects of the domain refinement on the magnetic properties of the grain-oriented silicon steel of Steel 2.

Domain refinement was achieved in Pack 40-33A but the electron beam conditions were of such severity that the Epstein strips were bent and deep grooves were cut through the coating on the silicon steel. The grooves were rough to the touch and would require further processing in an effort to make a satisfactory final product.

Figure 2:
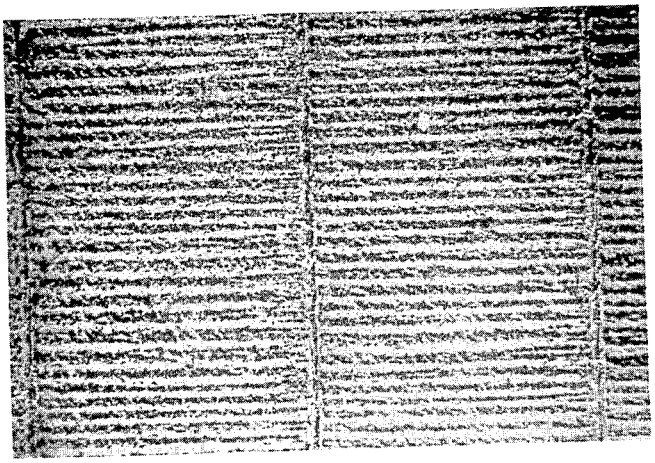
FIG. 2 is a 7.5×photomicrograph of the magnetic domain structure of Steel 2 of Example I, in accordance with the present invention.

Because of the extreme deformation and coating damage, Pack 40-33A was annealed at 1475° F. to flatten the strips and exhibited watt losses which were lower than the Control values. The strips of Pack 40-33A were than coated with a known tension coating. The watt losses were slightly lower after tension coating than the Control Pack in the as-received condition. Domain imaging was conducted in a known manner with magnetite suspension and flexible permanent magnets to determine the effect on domain refinement. FIG. 2 is a 7.5×photomicrograph which shows that the domain refinement survived the SRA and tension coating. The pack was reannealed twice more and watt loss properties measured each time as shown with overall improvement of 4% at 1.5T and 5% at 1.7T as compared to the Control Pack. The stability of the domain refinement and its heat resistance are demonstrated by such data. These favorable results indicate that at least one additional processing step is necessary to yield a heat-resistant domain refined product which initially exhibits a deterioration in magnetics in the as-treated condition.

FIG. 1 is a Scanning Electron Microscope (SEM) photomicrograph in partial cross-section of a treated zone of a strip of Pack 40-33A shown by a nital-etching. Although there is no intent to be bound by theory, there is a proposed mechanism for producing heat resistant domain refinement in accordance with the present invention. High energy electron beam treatment produces a cavity in the metal strip which is back filled by the melted metal strip as the electron beam moves relative to the strip. When the melt solidifies, an interface between the metal strip and the treated zone results as shown in FIG. 1. Defects such as pores or "cold-shuts" (voids due to poor adhesion of the resolidified metal to the metal strip) may be created in the subsurface. If the metal strip has a coating thereon, such as a forsterite base-coating, mill glass, or an insulation coating for example, some of the coating material may be deposited into the cavity and melted into the zone. If the resolidified metal adheres well to the cavity wall, then the interface between the strip and the resolidified zone may disappear all, or in part, due to a subsequent high temperature anneal; however, the pores and cold-shut defects remain for the nucleation of domain walls. Another embodiment suggests that a preferred mechanism for generating heat resistant domain refinement is the interaction of tension or stress with the electron beam induced defects. Such defects and any residual stresses not relived by annealing can be sufficient for nucleation of domain walls when tension is applied. Applying a stress coating which does not degrade upon annealing will provide "heat resistant" localized stresses introduced by the tension/defect interaction.

EXAMPLE II

By way of further examples, additional tests were performed to demonstrate the heat resistant domain refined (HRDR) magnetic properties after stress relief annealing (SRA) of the samples in Table II and III obtained from various samples of nominally 9-mil silicon steel of the typical composition of Steel 2 described in Example I and subjected to a similar stress relief anneal. For Table II, Epstein Packs 40-37A, 40-35A contained final texture annealed strips having a forsterite base coating thereon in the Control Pack. The other Epstein packs contained final texture annealed strips having a forsterite base coating and a stress or tension coating thereon in the Control Pack. For Table III all of the Single Sheet Panels were final texture annealed having a forsterite base coating and a stress or tension coating thereon in the Control Pack. All of the samples were electron beam treated by fixing the samples in place to a table translated in the rolling direction and deflecting the beam to scan across the strips. Some of the samples were about 1.2 inch wide strips for Epstein packs and some were 4×22 inch Single Sheet panels as indicated.

TABLE II

| Epstein Pack | Electron Beam Conditions: Current (ma) | Voltage (kV) | Speed (ips) | Linear Energy Density (J/in.) | Core Loss @ 60 Hz (mWPP): 1.3 T | 1.5 T | 1.7 T | Permeability: @ 10H | @ 200B |
|---|---|---|---|---|---|---|---|---|---|
| 40-8 | | | | | | | | | |
| (Control) | — | — | — | — | 327 | 434 | 588 | 1894 | 12420 |
| Treated | 1.0 | 60 | 3.3 | 17.5 | 659 | 817 | 1020 | 620 | 253 |
| SRA | — | — | — | — | 305 | 414 | 576 | 1894 | 9900 |
| T-Coated | | | | | 302 | 408 | 567 | 1888 | 11900 |
| 2nd SRA | | | | | 305 | 411 | 569 | 1892 | 11170 |
| 40-37A | | | | | | | | | |
| (Control) | — | — | — | — | 323 | 437 | 621 | 1893 | 12000 |
| Treated | 1.0 | 60 | 3.3 | 17.5 | 671 | 831 | 1040 | 616 | 258 |
| SRA | — | — | — | — | 317 | 430 | 606 | 1896 | 8700 |
| T-Coated | | | | | 310 | 418 | 586 | 1885 | 10150 |
| 40-9 | | | | | | | | | |
| (Control) | — | — | — | — | 318 | 427 | 587 | 1890 | 11430 |
| Treated | 6.5 | 150 | 250 | 3.88 | 523 | 665 | 828 | 1254 | 1120 |
| SRA | — | — | — | — | 306 | 415 | 579 | 1890 | 10750 |
| T-Coated | | | | | 312 | 421 | 587 | 1885 | 11360 |
| 2nd SRA | | | | | 314 | 421 | 581 | 1885 | 11240 |
| 40-34A | | | | | | | | | |
| (Control) | — | — | — | — | 324 | 436 | 605 | 1899 | 13000 |
| Treated | 6.5 | 150 | 250 | 3.88 | 527 | 662 | 822 | 1334 | 1170 |
| SRA | — | — | — | — | 312 | 421 | 589 | 1889 | 11560 |
| 2nd SRA | | | | | 316 | 426 | 589 | 1889 | 11170 |

TABLE II-continued

| Epstein Pack | Electron Beam Conditions: Current (ma) | Voltage (kV) | Speed (ips) | Linear Energy Density (J/in.) | Core Loss @ 60 Hz (mWPP): 1.3 T | 1.5 T | 1.7 T | Permeability: @ 10H | @ 200B |
|---|---|---|---|---|---|---|---|---|---|
| 40-35A | | | | | | | | | |
| (Control) | — | — | — | — | 323 | 434 | 604 | 1892 | 12600 |
| Treated | 6.5 | 150 | 250 | 3.88 | 533 | 669 | 832 | 1324 | 1110 |
| SRA T-Coated | — | — | — | — | 311 | 420 | 581 | 1895 | 9090 |

T-Coated - Tension Coated

TABLE III

| Single Sheet Panel | Electron Beam Conditions: Current (ma) | Voltage (kV) | Speed (ips) | Linear Energy Density (J/in.) | Core Loss @ 60 HZ (mWPP): 1.3 T | 1.5 T | 1.7 T | Permeability: @ 10H | @ 200B |
|---|---|---|---|---|---|---|---|---|---|
| 69ABC | | | | | | | | | |
| (Control) | — | — | — | — | 300 | 412 | 589 | 1895 | 12420 |
| Treated | 4 | 150 | 2080 | 0.29 | 288 | 400 | 578 | 1891 | 13160 |
| SRA | — | — | — | — | 302 | 413 | 582 | 1907 | 11760 |
| 64ABC | | | | | | | | | |
| (Control) | — | — | — | — | 301 | 418 | 589 | 1898 | 11630 |
| Treated | 5 | 150 | 2080 | 0.36 | 290 | 400 | 566 | 1893 | 12500 |
| SRA | — | — | — | — | 301 | 416 | 583 | 1908 | 11110 |
| 75ABC | | | | | | | | | |
| (Control) | — | — | — | — | 302 | 420 | 600 | 1882 | 12350 |
| Treated | 6 | 150 | 2080 | 0.43 | 290 | 400 | 563 | 1881 | 13160 |
| SRA | — | — | — | — | 305 | 418 | 596 | 1898 | 11830 |
| 50ABC | | | | | | | | | |
| (Control) | — | — | — | — | 304 | 432 | 615 | 1909 | 10360 |
| Treated | 5 | 150 | 2080 | 0.36 | 293 | 411 | 581 | 1908 | 11110 |
| SRA | — | — | — | — | 315 | 438 | 622 | 1905 | 9900 |
| 54ABC | | | | | | | | | |
| (Control) | — | — | — | — | 326 | 453 | 640 | 1900 | 10100 |
| Treated | 5 | 150 | 2080 | 0.36 | 299 | 415 | 590 | 1900 | 11110 |
| SRA | — | — | — | — | 322 | 440 | 631 | 1904 | 10000 |

Under the experimental conditions described above for stress relief annealing for given electron beam conditions to effect domain refinement, Table II demonstrates that some samples have improved magnetic core loss properties after SRA. Epstein Packs 40-8 and 40-37A were subjected to electron beam treatment using the same parameters as for Pack 40-33-A of Example I. The packs seemed to respond similarly. The strips treated with 150 kV were bent more severely than strips scribed with 60 kV even though the linear energy densities were lower. Domain images showed that the stressed zones tended to be more localized in strips scribed with 150 kV. Generally, the packs exhibited a deterioration in magnetic properties in the as-treated condition; however, they also exhibited an overall 2 to 7% watt loss reduction after one SRA. All but Pack 40-34A was coated with a known tension coating after the first SRA. The watt losses were slightly lower after the tension coating for Packs 40-8 and 40-37A. For these Packs, a second SRA did not improve core loss but it demonstrated the permanence of the defect in providing a heat resistant domain refinement.

Prior to the tests for Table III, preliminary tests were conducted for traversing speeds of 1000 and 2000 ips over a range of electron beam currents ranging from 2 to 10 ma resulting in linear energy densities from 0.14 to 1.47 Joules/inch. Comparisons confirmed that approximately 0.3 Joules/inch is the threshold density at 150 kV beam voltage for initiating domain refinement. None of the samples exhibited any visible disruption or disturbance of the coating and only a slight curvature or warpage of the strip. Although all of the samples exhibited significant core loss reductions in the as-treated condition, none of the samples exhibited any significant hear resistant domain refinement after SRA confirming the need for higher energy density for HRDR effect.

EXAMPLE III

Various samples of nominally 9-mil silicon steel having the typical composition of Steel 2 were prepared as described in Example II to provide final texture annealed samples having a forsterite base coating. The samples were magnetically tested as-received to obtain control level properties. All of the samples are Epstein single strip results from strips of 1.2×12 inches processed under the experimental conditions described in Table IV with parallel bands of treated regions about 6 mm apart. All of the electron beam domain refining treatment was done with an electron beam having a voltage of 150 kilovolts, a current of 3 or 4 milliamperes and scan speed of 35 or 70 ips to provide different linear energy density levels as indicated. All the strips were initially heat flattened by stress relief annealing as in Example I, then tension coated with a known stress coating and then subjected to a second SRA at 1475° F. for 2 hours in a protective atmosphere. Magnetic properties were determined after each step as indicated.

TABLE IV

| Epstein Single Strip | Permeability: @ 10 H | @ 200 B | Core Loss @ 60 Hz (mWPP): 1.3 T | 1.5 T | 1.7 T |
|---|---|---|---|---|---|
| 12.8 J/in @ 3 mA, 35 inch/sec scan speed | | | | | |

TABLE IV-continued

| Epstein Single Strip | Permeability @ 10 H | Permeability @ 200 B | Core Loss @ 60 Hz (mWPP) 1.3 T | 1.5 T | 1.7 T |
|---|---|---|---|---|---|
| #50 as-recd | 1907 | 10040 | 327 | 440 | 623 |
| scr. + SRA | 1905 | 8460 | 290 | 392 | 541 |
| +T-coated | 1885 | 8550 | 301 | 405 | 564 |
| 2nd SRA | 1885 | 8790 | 290 | 390 | 545 |
| #51 as-recd | 1915 | 9500 | 326 | 440 | 635 |
| scr. + SRA | 1911 | 9180 | 288 | 387 | 534 |
| +T-coated | 1891 | 9220 | 307 | 408 | 564 |
| 2nd SRA | 1892 | 9180 | 296 | 401 | 553 |
| #52 as-recd | 1899 | 11360 | 302 | 408 | 580 |
| scr. + SRA | 1892 | 8590 | 301 | 412 | 580 |
| +T-coated | 1877 | 9660 | 291 | 395 | 558 |
| 2nd SRA | 1878 | 9270 | 287 | 392 | 554 |
| #57 as-recd | 1904 | 10760 | 324 | 437 | 598 |
| scr. + SRA | 1902 | 8440 | 309 | 418 | 583 |
| +T-coated | 1889 | 8990 | 309 | 413 | 575 |
| 2nd SRA | 1884 | 8930 | 297 | 405 | 557 |
| #58 as-recd | 1918 | 12410 | 298 | 411 | 564 |
| scr. + SRA | 1912 | 9050 | 287 | 385 | 535 |
| +T-coated | 1889 | 9830 | 290 | 394 | 549 |
| 2nd SRA | 1895 | 10140 | 272 | 372 | 516 |
| #59 as-recd | 1914 | 12730 | 316 | 421 | 577 |
| scr. + SRA | 1904 | 9680 | 297 | 402 | 551 |
| +T-coated | 1885 | 11320 | 300 | 400 | 555 |
| 2nd SRA | 1889 | 10250 | 311 | 415 | 566 |
| #60 as-recd | 1908 | 11590 | 354 | 485 | 650 |
| scr. + SRA | 1905 | 8950 | 305 | 418 | 586 |
| +T-coated | 1886 | 9710 | 301 | 413 | 586 |
| 2nd SRA | 1890 | 9760 | 297 | 409 | 568 |
| #65 as-recd | 1804 | 7260 | 340 | 479 | 745 |
| scr. + SRA | 1799 | 5360 | 377 | 527 | 786 |
| +T-coated | 1784 | 5900 | 346 | 480 | 750 |
| 2nd SRA | 1786 | 5580 | 346 | 473 | 739 |
| #66 as-recd | 1873 | 9140 | 327 | 458 | 656 |
| scr. + SRA | 1863 | 7770 | 316 | 440 | 641 |
| +T-coated | 1848 | 8120 | 305 | 430 | 626 |
| 2nd SRA | 1852 | 7720 | 294 | 416 | 604 |
| #67 as-recd | 1836 | 7860 | 321 | 464 | 685 |
| scr. + SRA | 1836 | 6510 | 313 | 434 | 647 |
| +T-coated | 1817 | 6830 | 335 | 458 | 676 |
| 2nd SRA | 1820 | 6530 | 328 | 447 | 665 |
| #68 as-recd | 1912 | 11660 | 313 | 429 | 598 |
| scr. + SRA | 1905 | 7890 | 332 | 455 | 643 |
| +T-coated | 1886 | 10220 | 294 | 395 | 557 |
| 2nd SRA | 1889 | 9780 | 290 | 391 | 550 |
| 6.4 J/in @ 3 mA, 70 inch/sec scan speed | | | | | |
| #15 as-recd | 1925 | 11360 | 305 | 416 | 571 |
| scr. + SRA | 1924 | 9470 | 298 | 409 | 569 |
| +T-coated | 1904 | 9880 | 287 | 388 | 535 |
| 2nd SRA | 1908 | 9880 | 276 | 373 | 512 |
| #16 as-recd | 1898 | 9350 | 314 | 429 | 589 |
| scr. + SRA | 1901 | 8330 | 283 | 387 | 546 |
| +T-coated | 1883 | 7770 | 295 | 397 | 558 |
| 2nd SRA | 1887 | 7940 | 287 | 389 | 543 |
| #32 as-recd | 1879 | 11320 | 354 | 471 | 649 |
| scr. + SRA | 1880 | 9500 | 323 | 449 | 638 |
| +T-coated | 1865 | 9880 | 323 | 451 | 633 |
| 2nd SRA | 1867 | 10040 | 327 | 451 | 633 |
| #36 as-recd | 1942 | 12570 | 342 | 457 | 596 |
| scr. + SRA | 1940 | 9880 | 331 | 445 | 604 |
| +T-coated | 1922 | 12450 | 297 | 402 | 548 |
| 2nd SRA | 1922 | 11880 | 294 | 402 | 544 |
| #48 as-recd | 1837 | 7970 | 349 | 493 | 708 |
| scr. + SRA | 1845 | 8090 | 323 | 448 | 663 |
| +T-coated | 1824 | 7360 | 327 | 465 | 689 |
| 2nd SRA | 1827 | 7100 | 334 | 473 | 689 |
| 8.6 J/in @ 4 mA, 70 inch/sec scan speed | | | | | |
| #13 as-recd | 1914 | 10000 | 363 | 474 | 623 |
| scr. + SRA | 1858 | 9160 | 283 | 383 | 542 |
| +T-coated | 1833 | 8810 | 317 | 426 | 610 |
| 2nd SRA | 1838 | 9200 | 280 | 377 | 539 |
| #14 as-recd | 1893 | 9010 | 344 | 463 | 649 |
| scr. + SRA | 1833 | 7780 | 302 | 417 | 614 |
| +T-coated | 1813 | 8460 | 316 | 429 | 624 |
| 2nd SRA | 1814 | 7970 | 309 | 425 | 616 |
| #23 as-recd | 1865 | 10640 | 356 | 492 | 688 |
| scr. + SRA | 1816 | 9030 | 326 | 458 | 673 |
| +T-coated | 1796 | 10060 | 325 | 459 | 683 |
| 2nd SRA | 1799 | 9710 | 318 | 448 | 668 |

TABLE IV-continued

| Epstein Single Strip | Permeability @ 10 H | Permeability @ 200 B | Core Loss @ 60 Hz (mWPP) 1.3 T | 1.5 T | 1.7 T |
|---|---|---|---|---|---|
| #31 as-recd | 1870 | 11190 | 321 | 448 | 628 |
| scr. + SRA | 1880 | 7480 | 288 | 396 | 570 |
| +T-coated | 1813 | 6840 | 298 | 413 | 616 |
| 2nd SRA | 1815 | 6480 | 272 | 373 | 568 |
| #41 as-recd | 1927 | 11700 | 341 | 451 | 609 |
| scr. + SRA | 1859 | 9780 | 289 | 395 | 549 |
| +T-coated | 1839 | 10820 | 281 | 386 | 542 |
| 2nd SRA | 1842 | 10330 | 278 | 378 | 531 |

Scr + SRA - electron beam treatment followed by SRA
T-coated - Tension coated

Under the experimental conditions described above, the data demonstrate that after electron beam treatment and SRA, the watt loss properties were reduced in 18 of the 21 single strips as compared to the as-received condition up to 19% improvement at 1.5 T. The watt losses were lower in 20 of 21 strips up to 15% at 1.5 T in the subsequent tension coated condition. The second SRA demonstrated the permanence of the domain refinement induced by the electron beam and tension coating since all 21 strips exhibited lower watt losses at 1.5 T when compared with the as-received condition. The data demonstrate that the tension/defect interaction results in heat resistant domain refinement.

For the experimental conditions of this example, the electron beam treatment of base coated strips yielded the best watt loss reductions at 4 ma and 8.6 J/in. linear energy density. With these parameters, the permeabilities at 10 Oersteds were reduced by about 55–94 $G/O_e$ after the second SRA when compared to the as-received condition. Metallographic analysis of the electron beam treated zones in cross-sections etched with nital showed that the melt zone depth and width increased with either beam current or linear energy density. As shown in Table V, the strips treated at 4 ma and 8.6 J/in. exhibit the deepest and widest melt zone. It appears that the decreases in permeability and reductions in watt loss are dependent upon the size of the electron beam created defect and should be controllable through process optimization.

TABLE V

| Electron Beam Conditions @ 150 kV | | | Treated Zone | | |
|---|---|---|---|---|---|
| Current (ma) | Speed (ips) | Linear Energy Density (J/in) | Depth (um) | Width (um) @ surface | Width (um) @ half-depth |
| 3 | 70 | 6.4 | 35 | 298 | 225 |
| 4 | 70 | 8.6 | 72 | 404 | 300 |
| 3 | 35 | 12.8 | 71 | 359 | 265 |

Figure 3:
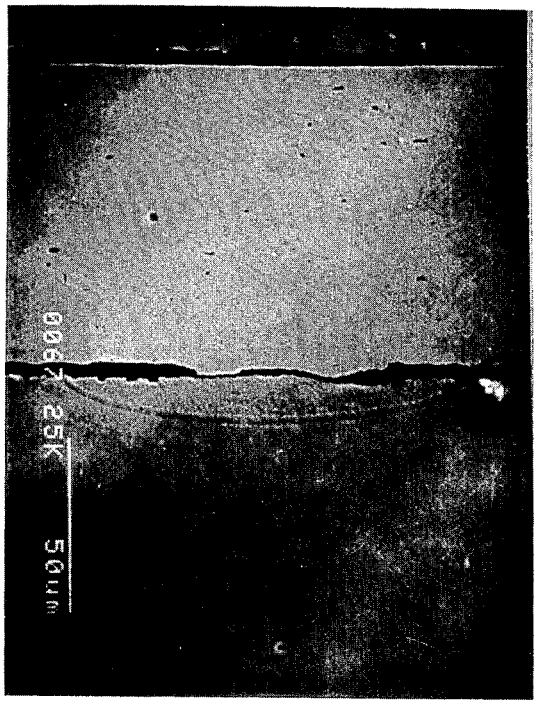
FIG. 3 is a photomicrograph in cross-section of Steel 2 illustrating coating damage and a resolidified melt zone.

FIG. 3 is an SEM photomicrograph at 600 X of Steel 2 in cross-section shown by nital etching (with copper spacer) illustrating minimal coating damage and a shallow resolidified melt zone in the treated region of about 12 microns. The sample of FIG. 3 was subjected to electron beam treatment of 2.25 J/in. at 150 kV, 0.75 ma, and 50 ips to effect heat resistant domain refinement just above the threshold for coating damage.

EXAMPLE IV

Additional tests were performed to effect domain refinement by a discontinuous or modulated electron beam and to explore the order or sequence of subsequent processing steps following the electron beam treatment. The beam current was modulated by a square pulse from a waveform generator. Various samples of 9-mil steel of Steel 2 were prepared as in Example III except strips in Packs A and C were base-coated and Packs 2 and 3 were stress-coated prior to electron beam treatment. All the magnetic properties are for 20-strip Epstein Packs of 1.2 inch wide strips. One surface of each strip was subjected to an electron beam treatment using a modulated beam energy of 100 Hertz pulsing at a voltage of 150 kilovolts at the currents and energy densities indicated in Table VI. After electron beam treatment, the strips of Packs A and C were tension coated with a known stress coating and then stress relief annealed as in Example I at 1475° F. for 2 hours in a protective atmosphere as indicated. Packs 2 and 3 were subjected to the same SRA after electron beam treatment. Pack 2 was also then tension coated as indicated. Magnetic properties were determined after each step as shown.

TABLE VI

| Pack | Permeability | | Core Loss @ 60 Hz (mWPP) | | |
|---|---|---|---|---|---|
| No./Condition | @ 10 H | @ 200 B | 1.3 T | 1.5 T | 1.7 T |
| 10.7 J/inch @ 1 mA, 14 inch/sec scan speed with 100 Hz pulse | | | | | |
| A as-recd | 1910 | 15380 | 310 | 422 | 591 |
| treated | 1644 | 1790 | 551 | 730 | 956 |
| +T-coated | 1912 | 14290 | 304 | 410 | 565 |
| SRA | 1910 | 14490 | 298 | 403 | 551 |
| 2 as-recd | 1909 | 13990 | 312 | 416 | 553 |
| treated | 1649 | 2150 | 533 | 715 | 948 |
| SRA | 1908 | 12740 | 311 | 414 | 553 |
| +T-coated | 1897 | 13160 | 315 | 417 | 553 |
| 10.7 J/inch @ 2 mA, 28 inch/sec scan speed with 100 Hz pulse | | | | | |
| C as-recd | 1933 | 17540 | 313 | 426 | 590 |
| treated | 1410 | 1460 | 806 | 1040 | — |
| +T-coated | 1898 | 12500 | 325 | 439 | 608 |
| SRA | 1898 | 15880 | 288 | 399 | 555 |
| 3 as-recd | 1905 | 13330 | 313 | 418 | 562 |
| scr. + SRA | 1832 | 11170 | 322 | 460 | 636 |

A,C - scribed as-base-coated
2,3 - scribed as-stress-coated
T-coated - Tension coated
Scr + SRA - Electron beam treatment followed by SRA Under the experimental conditions described above, it was found that the pulsed or modulated electron beam treatment yielded minimal strip curvature even at the relatively high linear energy density of 10.7 J/in. All of the strips from Packs A, C, 2, and 3 were flat as-treated indicating that a SRA or other heat flattening step may be eliminated after the electron beam treatment, if a subsequent operation, such as tension coating, is to be employed.

The data of Example IV also show that the electron beam treatment was more effective on base-coated strip. Packs 2 and 3, which were stress coated prior to the electron beam treatment, did not result in reduced core loss properties under the parameters used.

The data of Table VI show that modulated electron beam treatment produces a permanent defect to effect heat resistant domain refinement in sheet suitable to provide reduced core loss. Furthermore, Packs A and C show that base-coated material may be stress coated after electron beam treatment and thereafter subjected to an SRA and still provide reduced core loss properties in the sheet product. In accordance with the heat resistant domain refinement process of the present invention, a subsequent heat treating or annealing up to 1800° F. (982° C.) is a critical step to achieve reductions in core loss properties. Electron beam treatment alone does not yield lower core loss properties. Furthermore, the invention includes embodiments of subsequent processing by tension coating and stress relief annealing in that order or in reversed sequence.

As was an object of the present invention, a method has been developed using electron beam treatment for effecting domain refinement of electrical steels, particularly exemplified by grain-oriented silicon steel to improve core loss values. A further advantage of the method of the present invention is that such improvements in core loss are heat resistant such that they survive a stress relief anneal and would be suitable for a wide variety of electrical applications.

Although a preferred and alternative embodiments have been described, it would be apparent to one skilled in the art that changes can be made therein without departing from the scope of the invention.

What is claimed is:

1. A method for improving the core loss properties of electrical sheet products, the method comprising:

annealing an electrical metal sheet to obtain its magnetic properties;

thereafter, subjecting at least one surface of the sheet to an electron beam treatment to produce narrow substantially parallel bands of treated regions separated by untreated regions substantially transverse to the direction of sheet manufacture;

said treated regions resulting from melting and resolidifying of metal strip in those regions;

the electron beam treatment including generating an electron beam with a voltage of 20 to 200 kilovolts, and providing an energy density sufficient to produce a permanent defect in each treated region to effect heat resistant refinement of magnetic domain wall spacing of the sheet up to 1800° F. suitable to provide reduced core loss.

2. The method of claim 1 wherein the linear energy density ranges from about 150 Joules per square inch or more.

3. The method of claim 2 wherein the energy density ranges from 150 to 4000 Joules per square inch.

4. The method of claim 2 wherein the linear energy density ranges from about 0.75 Joules per inch or more for an electron beam spot size of about 5 mils across.

5. The method of claim 2 wherein the linear energy density ranges from 0.75 to 20 Joules per inch.

6. The method of claim 2 wherein the electron beam is generated with a current of 0.5 to 100 milliamperes.

7. The method of claim 1 wherein thereafter annealing the treated sheet to provide a sheet product with reduced core loss.

8. The method of claim 7 wherein said annealing of the sheet includes temperatures up to 1800 degrees F. to provide a sheet product having reduced core loss.

9. The method of claim 1 wherein after the electron beam treatment, recoating the sheet product on at least one side when said sheet product had a coating thereon prior to the electron beam treatment.

10. The method of claim 9 wherein recoating includes applying a tension coating to at least one surface of the treated sheet to reduce core loss.

11. The method of claim 1 wherein thereafter processing the treated sheet by both annealing and applying a tension coating to reduce core loss.

12. The method of claim 1 further providing continuous electron beam energy to effect heat resistant domain refinement.

13. The method of claim 1 further providing discontinuous electron beam energy to effect heat resistant domain refinement.

14. The method of claim 1 wherein the sheet is steel selected from a group consisting of conventional cube-on-edge grain-oriented silicon steel, high permeability cube-on-edge grain-oriented silicon steel and amorphous magnetic metals.

15. The method of claim 1 wherein the sheet final gauge ranges up to about 14 mils.

16. The method of claim 1 including the step of providing at least a partial vacuum in the vicinity of the strip being subjected to the electron beam treatment.

17. The method of claim 1 including the step of providing deflection of the electron beam substantially transverse to the rolling direction of the sheet at a speed of up to 10,000 inches per second.

18. A method for improving the core loss properties of electrical sheet products, the method comprising:

annealing an electrical metal sheet to obtain its magnetic properties;

thereafter, subjecting at least one surface of the sheet to an electron beam treatment in the vicinity of at least a partial vacuum to produce narrow bands of treated regions separated by untreated regions substantially transverse to the direction of sheet manufacture;

said treated regions resulting from melting and resolidifying of metal strip in those regions;

the electron beam treatment includes providing sufficient energy density ranging from about 150 Joules per square inch or more, and providing relative movement between the electron beam and the sheet of up to 10,000 inches per second substantially transverse to the direction of rolling of the sheet to produce a permanent defect in each treated region to effect heat resistant refinement of magnetic domain wall spacing of the sheet up to 1800° F. suitable to provide reduced core loss; and thereafter annealing the sheet to provide a sheet product having reduced core loss.

19. The method of claim 18 further includes recoating the sheet product or at least one side when said sheet product had a coating thereon prior to the electron beam treatment.

* * * * *